US007745716B1

(12) United States Patent
Murphy

(10) Patent No.: US 7,745,716 B1
(45) Date of Patent: Jun. 29, 2010

(54) MUSICAL FITNESS COMPUTER

(76) Inventor: Michael Shawn Murphy, 1307 Woodmoor Dr., Allen, TX (US) 75013

( * ) Notice: Subject to any disclaimer, the term of this patent is extended or adjusted under 35 U.S.C. 154(b) by 1480 days.

(21) Appl. No.: 11/009,468

(22) Filed: Dec. 10, 2004

Related U.S. Application Data

(60) Provisional application No. 60/529,529, filed on Dec. 15, 2003.

(51) Int. Cl.
*G10H 7/00* (2006.01)

(52) U.S. Cl. ..... 84/612

(58) Field of Classification Search ..... 84/612; 700/94; 482/3–9, 900, 901
See application file for complete search history.

(56) References Cited

U.S. PATENT DOCUMENTS 5,267,942 A * 12/1993 Saperston ..... 600/28
6,230,047 B1 * 5/2001 McHugh ..... 600/519
6,307,141 B1 * 10/2001 Laroche et al. ..... 84/636
6,316,712 B1 * 11/2001 Laroche ..... 84/636
6,623,427 B2 * 9/2003 Mandigo ..... 600/300
7,207,935 B1 * 4/2007 Lipo ..... 600/28

* cited by examiner

*Primary Examiner*—Jeffrey Donels
(74) *Attorney, Agent, or Firm*—Robert E. Wise

(57) ABSTRACT

An audio player comprises a means of dynamically sensing the rate of repetitive motion of the user, a means for storing digital music files, a means for retrieving and dynamically playing at least one of said music files at a rate approximately equal to the sensed rate of repetitive motion of the user, and a means for dynamically calculating and displaying information and/or statistics regarding at least one of the music file and the user. Such a device can play music, or other audio content with a repetitive beat, in substantial synchrony with the repetitive motion of the user. The device also allows the user to dynamically choose or change the music file playing. The device may detect, calculate, and display to the user various information.

11 Claims, 9 Drawing Sheets

MUSICAL FITNESS COMPUTER

CROSS-REFERENCE TO RELATED APPLICATION

The present application claims the benefit of 35 U.S.C. §111(b) Provisional Patent Application Ser. No. 60/529,529, filed on Dec. 15, 2003, and entitled "Musical Fitness Computer".

DESCRIPTION OF THE PRIOR ART

People enjoy exercising to music. Whether alone or in a group, whether the exercise is slow or fast, whether indoors or outdoors, music makes exercise more enjoyable. Music is a welcome accompaniment no matter what kind of exercise is being performed—running, weight-lifting, or aerobic dance. Any kind of repetitive motion can be exercise, and music can accompany any kind of repetitive motion.

When exercising to music, people prefer to coordinate or synchronize their exercise speed or exercise gait speed to the speed of the music's beat. People sometimes choose to play particular songs because their beat speed, slower or faster, approximately matches the speed at which they wish to exercise.

Some forms of exercise, particularly walking, jogging, or running, is usually done at relatively unchanging speeds or gaits. Other forms of exercise, such as aerobic dance, are purposely performed at varying speeds. For example, it is normal to begin an exercise period slowly to loosen up one's muscles and to stretch. After the warm-up period, one may then move into a period of increasingly fast exercise to increase one's heart rate to a desired level, at which time the speed is kept relatively steady for a certain time to obtain the maximum safe cardiovascular workout. During this period of maximum workout, the speed may vary somewhat between periods of maximum speed for intense exercise and one or more periods of somewhat slower (but still relatively fast) speeds. After a period of intense exercise, when fatigue begins to set in, one may decrease the rate of exercise until one has cooled down and is ready to stop. Of course, the scripts of possible exercise routines are as many and varied as there are people exercising.

In the past, the leaders of groups of exercise participants have sometimes chosen a series of songs or musical beats for their particular beat speed. They may have chosen slower songs for the initial warm-up period, fast songs for the intermediate intense work-out period, and other songs of progressively slower beats for the cool-down period.

People use a wide variety of music players to play the music to which they listen during their exercise routine. If they exercise in groups, they will usually generate the music from relatively large audio speakers driven by a tape player, compact disk (CD) player, MP3 player, flash memory player, or other such device. If they exercise alone, they may utilize a compact, portable music player and an associated set of headphones, particularly where there may be other people about who do not wish to hear the music, or who are listening to music of their own through other headphones.

People who exercise have also used a variety of devices to help measure or quantify their exercise routine. For example, people have sometimes employed simple pedometers for exercises that incorporate or mimic running, so as to measure or approximate the distance they did or would have traveled during their exercise routine. A pedometer may provide some approximate measure of the amount of exercise performed, so that the user would know that they had exercised adequately and/or not excessively.

Heart rate monitors of more or less complexity have sometimes been employed for differing reasons. Some users may desire to monitor their heart rate during exercise to verify that the intensity of their exercise is sufficiently demanding or not overly demanding.

Such monitoring devices usually have a display of some sort so that the user can read the output of the monitoring device. The device and its display are necessarily relatively small and lightweight so as to not hinder the user during exercise.

People who exercise to music may like to know the title of a particular song which is played during the exercise period, or they may want to immediately choose or change a particular song. They may have certain series of songs which they want to play in a particular order during their exercise routine.

People may desire to have a series of songs which are chosen at random from a larger group of songs for a particular period of exercise. For example, a person may like to play one of several particular songs during a certain point of their exercise routine, but they do not want the same song at that point during every exercise routine because it would be boring. They want to choose a particular song on a particular day, or they may want one of a particular group of songs chosen at random.

Some songs may be preferred for particular exercise routines, but may not have the desired beat speed. This may occur because the particular song is too fast or too slow for that particular phase of the exercise, or perhaps the song will be played during a period when the exerciser is changing the speed of exercise relatively quickly.

It is known that when the speed of a particular piece of music is changed, its pitch is altered. If the speed change is small, the change in pitch may not be particularly noticeable. But it does not require much of a change in speed to alter pitch to a degree that most listeners find undesirable. In the past, ways have been discovered to substantially change the speed of music without substantially altering its pitch, so that listeners will still find the music enjoyable even though its speed is substantially different.

Prior art techniques that change the speed of music, without changing its pitch, include Time Domain Harmonic Scaling and Phase Vocoding. These known techniques utilize music in digital form.

SUMMARY OF THE INVENTION

1. Objectives of the Invention

It would be desirable to "design" a series of songs where the entire series of songs has a total play time and each song played has a chosen specific preset beat speed that is desirable for the point of time it is to be played. The series of songs would constitute exercise music.

It would further be desirable if the music player playing designed exercise music had one or more monitoring devices to display to the user parameters of the users physical condition during the workout.

It would also be desirable if the user could control the beat speed of the music being played by the music player based on feedback from the user. For example, during a particular workout, the user might feel like exercising faster or slower. If the user moved faster, it would be desirable if the music player could sense the user's faster gait and increase the speed of the music being played to synchronize the speed of the music to the speed of the user's exercise gait or rate. The user would then enjoy a dynamic feedback system where the music's beat speed followed his or her exercise rate without distorting the music's pitch. The system would continuously and rapidly monitor and sense the user's exercise rate or gait speed, and dynamically cause the music's beat speed to adjust to that rate or speed without any undesirable distortion of the music.

It may also be desirable for the unit to dictate a pre-determined speed for the user to follow. The unit may be configured to play back all songs on the play list at a single user-defined beat-per-minute (BPM) speed regardless of the speed at which the music was originally recorded. The user merely exercises to the modified beat of the music to attain the workout statistics as calculated by the player.

It would also be desirable if the user could quickly and easily choose a particular song or a particular series of songs while the user was exercising. It would be desirable if the user could continuously read one or more parameters of his or her performance during exercise, such as gait speed, distance traveled, heart rate, etc.

It would be desirable if such a system were relatively portable, light-weight and easy to use, so that it would not substantially interfere with the user's workout.

2. Statement of the Invention

An audio player comprises a means of dynamically sensing the rate of repetitive motion of the user, a means for storing digital audio files, a means for retrieving and dynamically playing at least one of said audio files at a rate approximately equal to the sensed rate of repetitive motion of the user, and a means for dynamically calculating and displaying information and/or statistics regarding at least one of the audio file and the user. Such a device can play music, or other audio content with a repetitive beat, in substantial synchrony with the repetitive motion of the user. The device also allows the user to dynamically choose or change the music file playing. The device may detect, calculate, and display to the user various information.

An audio player comprises a digital microcontroller which receives digital inputs from at least one of user controls, a pedometer, or a heart rate sensor; a storage means for digitally storing at least one audio file and at least one beat file, and for outputting said at least one audio file and said at least one beat file, said storage means being controlled by the microcontroller; a digital signal processor, comprising a microprocessor, which receives said at least one audio file and said at least one beat file from the storage means, said digital signal processor capable of overlaying a beat file onto at least one audio file, said digital signal processor being controlled by the microcontroller; and means for generating audible sound from said overlaid digital audio file. The audio player may further comprise an output display for receiving information from the microcontroller and displaying said information to a user.

A method of playing music or other sounds for a human user comprises the steps of retrieving a digital music file from a digital storage medium, creating or retrieving a beat file for said digital music file, overlaying said beat file on said digital music file, and then causing the overlaid digital music file to create audible sound for a user. This method may further include calculating information about the music contained in the file, and displaying said information to the user.

A method of playing music or other sounds comprises the steps of retrieving at least one digital music file from a digital storage medium; detecting, calculating, or retrieving at least one statistic of the physical movement of a user who is engaging in repetitive physical movement; creating a beat file for said digital music file(s) such that the beat of the music on the digital music file(s) will substantially match the beat of the repetitive motion of the user; overlaying said beat file on said digital music file(s); and causing audible sound to be created from the overlaid digital music file(s).

DESCRIPTION OF THE PREFERRED EMBODIMENT

A user's repetitive motion taken over time gives what can be called the user's steps per minute. The musical fitness computer of this invention is designed to play music at approximately the rate of the user's repetitive motion. In other words, the musical fitness computer will generate music such that the music's beats per minute will approximately equal the user's steps per minute.

The musical fitness computer of this invention utilizes computer software to identify the beat of music to extrapolate user information and exercise statistics. The existence of a beat file overlying a music file makes possible the calculation of information and exercise statistics before the music is played. In this application, the terms "beat file" and "tempo file" are used interchangeably. Also, in this application, the terms musical fitness computer and music player are used interchangeably.

The musical fitness computer can utilize any means of sensing the user's repetitive motion to dynamically advance or retard the beat file. The beat file is overlaid on the music file and processed in real time. Therefore, advancing or retarding the beat file in response to sensed changes in the user's repetitive motion also causes the music file to be similarly advanced or retarded. This, then, causes the music to be played approximately in synchrony with the user's gait in a dynamic manner. The music is adjusted by prior art techniques so that its pitch is not unacceptable to the listener.

The Microcontroller

Figure 1:
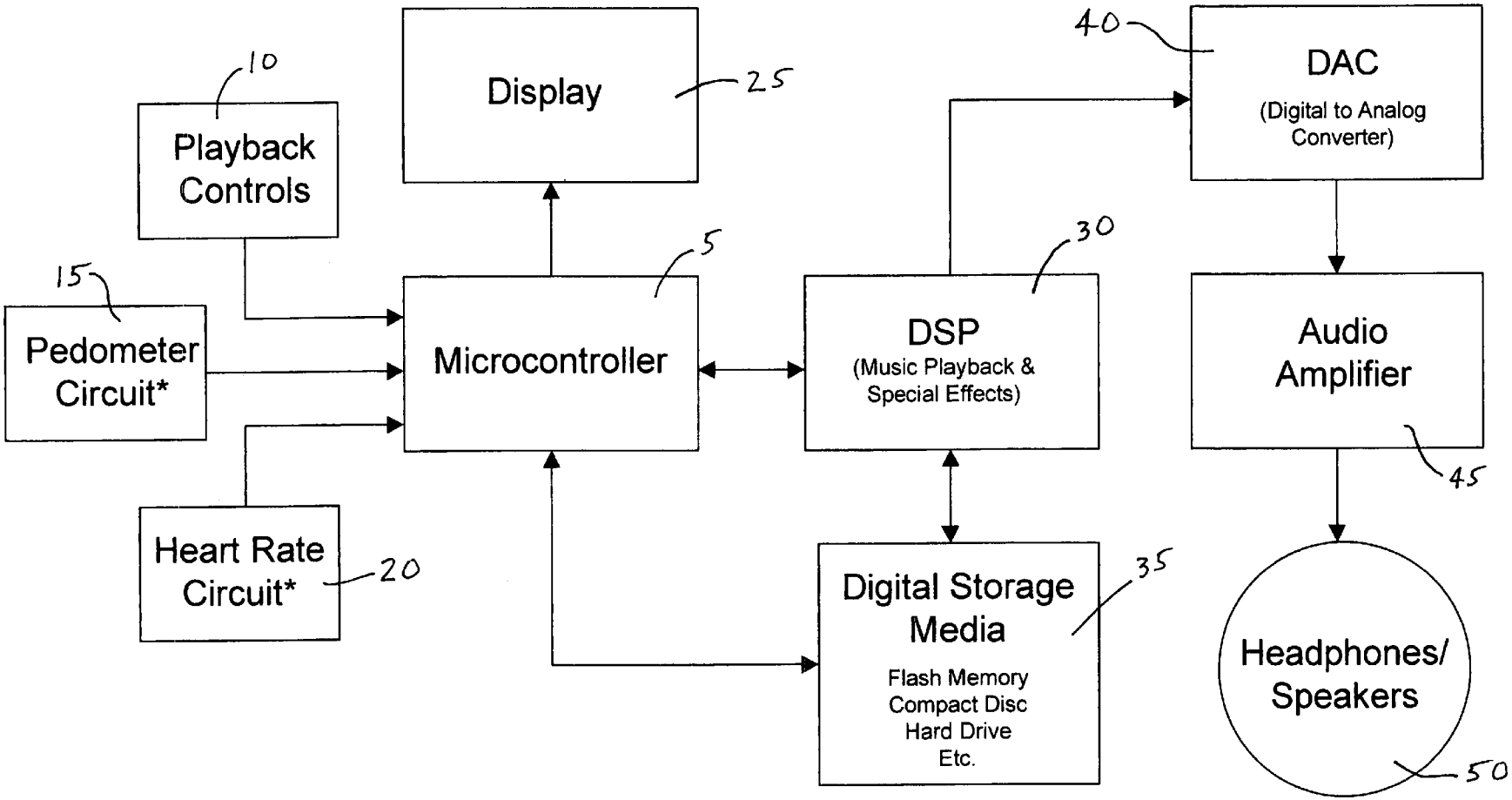
FIG. 1 is a schematic diagram of the components of the preferred embodiment of this invention.

FIG. 1 shows a schematic diagram of the preferred embodiment of this invention. The musical fitness computer utilizes a microcontroller 5 to receive dynamic inputs and user commands, generate information to be displayed, and dynamically control the system. The microcontroller 5 may be a digital microprocessor chip.

Based on the user's control input, the microcontroller 5 may statically command the playing of a program of music which has a preset tempo, either steady or varying in a preprogrammed manner. Alternatively, the microcontroller 5 may monitor the user (continuously or by sampling) and dynamically control the music played to synchronize the beat speed of the music to the exercise rate or gait speed of the user.

Inputs to the microcontroller 5 may include one or more user controls 10, a pedometer monitor 15, a heart-rate monitor 20, a dynamic stride length sensor (not shown), or any other device that senses (dynamically or statically) a parameter of the user. By utilizing the user controls 10, the user may manually enter information into the microcontroller, such as stride length and user body weight. The inputs received from the pedometer monitor 15 and the heart-rate monitor 20 would arrive in the form of simple ON and OFF signals which the microcontroller's microprocessor reads digitally.

The microcontroller 5 may generate and/or retrieve information to be displayed to the user, such as playlist, current song title, time elapsed, gait speed, stride distance, heart-rate, battery status, or any other parameter (static or dynamic) for which there is information available. A primary objective of this invention is to display to the user workout statistics, including one or more of speed, calories burned, distance traveled, steps or repetitions taken and/or steps taken up to any point in the workout, and other such statistics. All such displayed statistics and information can be on a dynamic or static basis. However, it is possible to not include any display device in this invention.

The microcontroller 5 may continuously generate information to be displayed to the user on an appropriate display device 25, such as a relatively small liquid crystal display (LCD) screen. Information generated by the microcontroller 5 for display may include one or more of the on-off state of the system, the music volume level, the current time, the state of any user commands, calories burned by the user, and any other desired information. "Calories burned" is a calculation that can either be generic, calculated for the average user and, therefore, less accurate; or user-specific by requiring the user to input his or her total body weight and/or other information specific to that user, and, therefore, more accurate.

The DSP

The microcontroller 5 provides digital output control signals to a digital signal processor (DSP) 30 to control the DSP's functions. The DSP 30 also receives digital music files from one or more digital storage media 35. The DSP 30 utilizes beat-identification software which can determine the beat of any digital music file and generate an associated beat file which is subsequently stored in digital memory. The DSP 30 can be any processor that can rapidly handle mathematically-intensive algorithms.

The digital music file is retrieved from a suitable storage medium 35, such as a CD player, a DVD player, an MP3 player, a computer hard drive, a flash memory storage device, a RAM or ROM digital storage device, or any other device which can store and retrieve information in digital electronic form. Less desirable, though possible, would be a storage device which retrieves music in analog form and converts it (whether in real time or not) to digital form. The storage medium may be internal of the musical fitness computer, or external to it. The storage medium 35 could be portable by a human, or so heavy or bulky that it is not portable. Multiple storage mediums and/or multiple types of storage mediums can be utilized.

The digital music file is transferred from its storage medium 35 to the DSP 30. The microcontroller 5, as part of its program and in response to its command inputs, commands the storage device 35 to send the digital music file to the DSP 30 for processing.

The musical fitness computer could also retrieve real-time music files, as from real-time radio or television transmissions via an integrated or separate tuner device. Alternatively, the music player could retrieve music files from an integrated or separate TiVo-type of device that receives and records in real-time, and plays the music either in real-time or from memory while skipping undesirable portions of a program such a commercial announcements.

The musical fitness computer may further include a file converter utility for permanently modifying the tempo of a musical file on a rewriteable storage medium, for the purpose of digitally distributing modified tempo music files with standard playback devices. This conversion would occur in the DSP.

The DAC/Amp/Speakers

The DSP 30 outputs the digital signal of the tempo-adjusted music file dynamically in real time to a digital-to-analog converter (DAC) 40, and the converted analog signal is appropriately amplified by an audio amplifier 45 and fed to the speakers as is well-known in this art. The digital-to-analog converter 40 and the audio amplifier 45 may be combined as an integrated device that simultaneously converts the digital signal to an analog signal and amplifies it to the commanded volume. The output of the amplifier 45 may be fed to one or more output terminal(s) disposed on the periphery of the housing of the musical fitness computer, where the user may connect headphones and/or other speakers 50 by means of a connector (not shown) connected to the output terminal(s). The speaker may be any type of speaker that can generate audible sound. Examples of speakers that might be used include large heavy speakers that are meant to be fixed or stationary, and small lightweight speakers such as those typically used in headphones.

The System in Actual Operation

Once the system shown in FIG. 1 is set up, operation may be as follows. The user first manually enters a command via the user controls to create a desired playlist or cause certain music to be played. The music commanded by the user resides initially in one of the digital storage media. The user's command causes the microcontroller to identify the desired music file and cause it to be retrieved from the digital storage medium and input into the DSP, along with its associated tempo file, if one exists for that music file.

If there is no tempo file for the desired music file, the music file alone is retrieved to the DSP. Tempo identification software resides on the DSP. This tempo identification software can determine the beat of the music in the retrieved music file, and it will create a tempo file for that music. Once created, the tempo file may be outputted to the digital storage media for storage in association with its music file, if the storage media is not of the read-only type. Thereafter, when the music file is retrieved, its associated tempo file is also retrieved. If the storage medium is of the read-only type, then the DSP will create a tempo file for the music file every time it is retrieved, but the tempo file will not be stored.

When a CD player, or other read-only storage device, is used to generate the music files, the music player will necessarily have on-board memory in which to store the tempo files. When music files are stored and retrieved from any media other than read-only, then both the music files and the tempo files will be stored together on the same storage medium.

Once a tempo file has been retrieved by the DSP for a particular song, the tempo file can be used to calculate and display user statistics prior to actually playing the song. To do this, the microcontroller retrieves from the DSP information about the tempo and uses it to calculate beats or steps per minute, calories expended, distance traveled (in conjunction with the user-entered stride length information), and other information that the user might want displayed. The calculated information is transmitted from the microcontroller to the display to cause the display to write the information in a readable form for display to the user. The information can be displayed before, during, or after the song is played.

Playback of a particular song is caused by simultaneously running the digital tempo file and the digital music file in the DSP, and outputting the time-adjusted digital stream to the DAC. Playback speed of the tempo file controls the speed at which the music is played.

If the user wears a pedometer sensing unit (which senses the gait of the user) and connects it to the system, the user can cause the system to use the beat created by the pedometer to advance the playback speed of the existing beat file and dynamically control the speed of playback. This would be particularly useful where the user wants to establish his or her own speed during an exercise interval. Minimum and maximum limits would be established in the DSP to provide a minimum and/or maximum playback speed to keep the music playing at some normal speed if the user should suddenly pause exercise while using the pedometer function (as where the user stops running to wait to cross a street). The pedometer sensing unit provides input to the microcontroller so that the user's gait speed will coordinate the speed of playback with the gait of the user. A pedometer sensing unit useful with this system may be internal to the player; or external to the player and connected to it by a wire, or by a wireless transmitter and receiver.

The musical fitness computer is able to play music that is dynamically variable by overlaying the music file on a DSP-controlled tempo file. The tempo file is a temporal map of the music file that pre-identifies a specific point in time where each beat of the music will occur. The existence of this file allows the microprocessor to auto-calculate all statistical information of each song or other audible piece before playback is initiated. The statistical information that can be calculated by the microprocessor may include speed, distance traveled, and calories burned, all in conjunction with the individual user's stride length. The information can be retrieved by the microcontroller and routed directly to the display. During music playback, the tempo file and the music file will run parallel to each other in the DSP. In this disclosure, a tempo file is the same thing as a beat file.

Display and Feedback Information

One of the necessary components of calculating distance traveled is stride length. The user's stride length could be input into the system by having the user manually enter into the microcontroller a stride length as a fixed quantity. The user's stride length might also be determined dynamically during exercise by a device worn by the user (as on his or her shoe) and the dynamically changing stride length calculated could be wirelessly transmitted to the microcontroller for dynamic computation and display of any parameter utilizing stride length.

When the user utilizes a heart monitor, the output of the heart monitor can be displayed on the device's display. The heart monitor can be any type of monitor that will detect the user's heartbeat and provide that information to the system. Such heart monitor might be connected to the system by a wire or by a wireless transmission and reception system. The information generated by the heart monitor might be used to control the minimum and/or maximum playback speed in order to dynamically control the user's exercise rate and achieve a desired minimum or maximum heart rate.

Although the description here focuses on the generation of music, the system of this invention can also generate any other sound, including human speech, that might accompany exercise. The description here also focuses on the use of the sound generated to accompany exercise. However, the sound generated, whether music, speech or any other sound, could also be used for any purpose other than exercise accompaniment. For example, the sound generated could accompany a human performing a work task, as in a factory setting. Persons of ordinary skill in this art will be able to identify various other uses of this invention and modify the teachings of this invention to accomplish purposes not specifically recited in this document.

The External Frame/Housing

FIGS. 2 to 9 show one example of the front face of the preferred embodiment of the music fitness computer as it might appear to the user. Each of FIGS. 2 to 9 shows different information displayed on the display screen. The exterior frame or housing 60 of the preferred embodiment may include user controls 65, one or more displays 70, connectors for music output to one or more speakers (not shown), and connectors for one or more inputs (not shown). A connector for a source of exterior power may be provided. Contained within the exterior frame or housing 60 is the musical fitness computer, and possibly a source of power such as a battery. It is desirable for the shape and exterior dimensions of the musical fitness computer to be as small as possible, while still being relatively easy for the user to hold or attach to the user's body or clothing.

The user controls 65 may be of any type, size or orientation; but should generally be relatively simple and easy for the user to operate. In FIGS. 2 to 9, the user control 65 is shown to comprise 4 buttons arrayed about a central button. As is common in such control arrangements, the center button commands the menu; the upper button commands "play" and "pause"; the lower button commands "stop"; the right button commands "next", "fast forward", or "go to the end"; and the left button commands "last", "rewind", or "go to the beginning". Other layouts and types of controls are within the scope of this invention.

The display(s) 70 should be sufficiently large that the user can read the information displayed, while still being relatively small and lightweight. The display(s) 70 can be any suitable means of displaying information to a user, such as a liquid crystal display (LCD) screen, a plasma display, a cathode ray tube, or any other suitable device. The display(s) 70 may be a touch-screen display that can provide all or additional inputs to the microcontroller 5 when the user touches the screen at an appropriate location.

The exterior of the housing 60 may include relatively simple user instructions or information, either in words or symbols. The exterior frame or housing 60 may have any desirable texture(s) or color(s) or shape.

Figure 2:
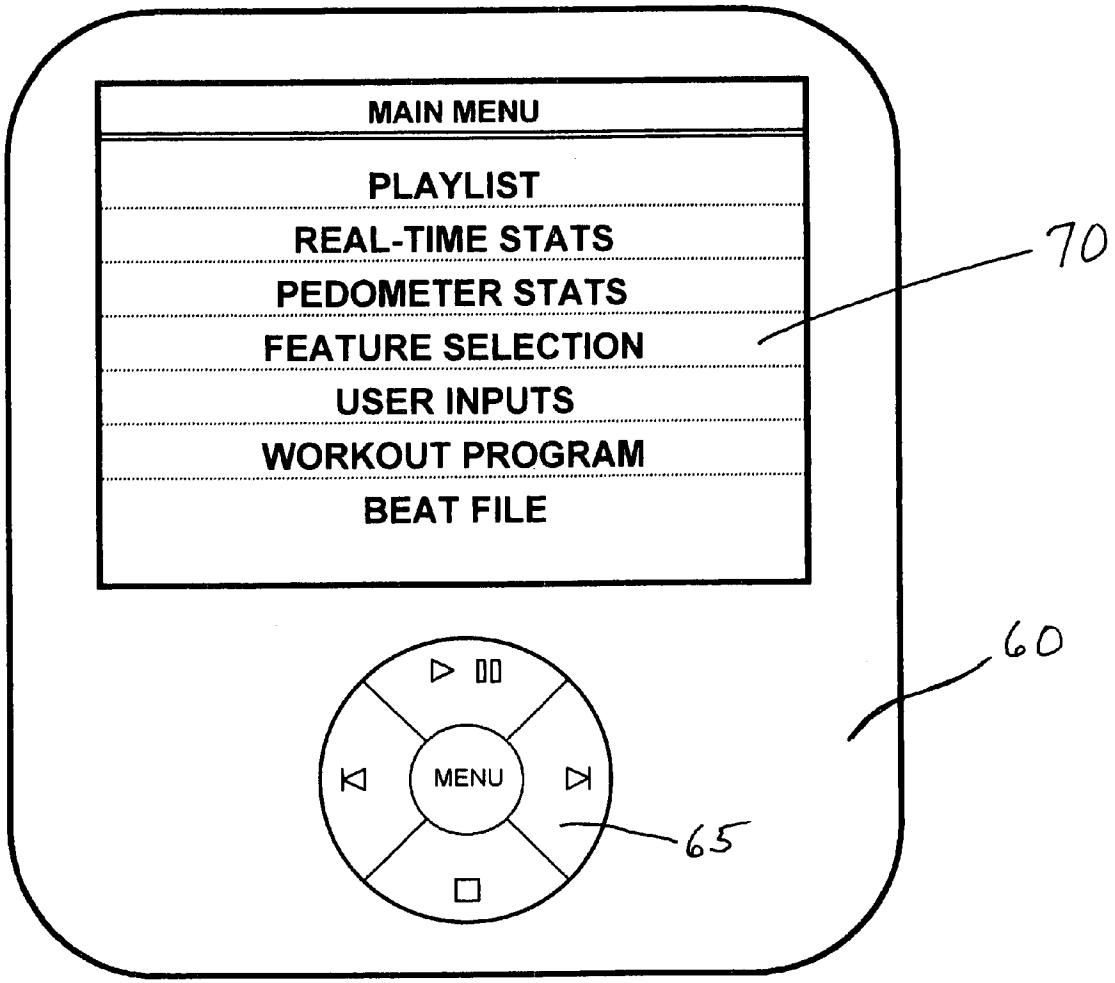
FIG. 2 shows an example of the front face of an enclosure of the preferred embodiment of this invention with a first set of displayed information.
Figure 3:
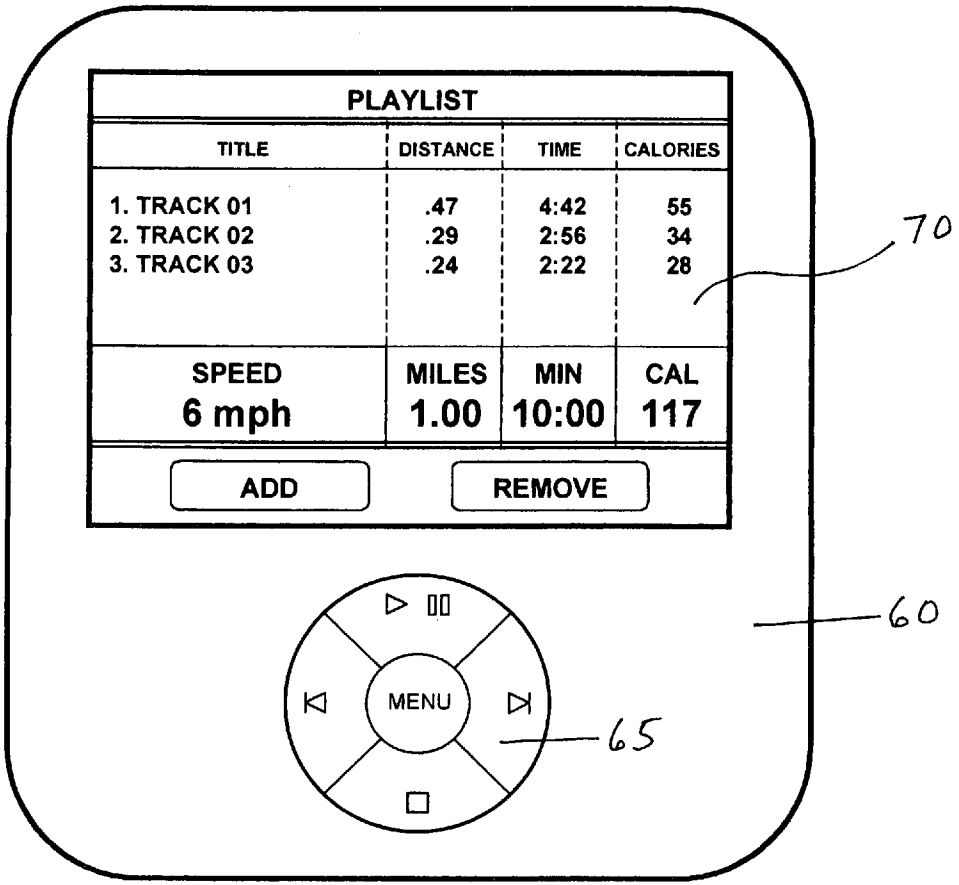
FIG. 3 shows an example of the front face of an enclosure of the preferred embodiment of this invention with a second set of displayed information.
Figure 4:
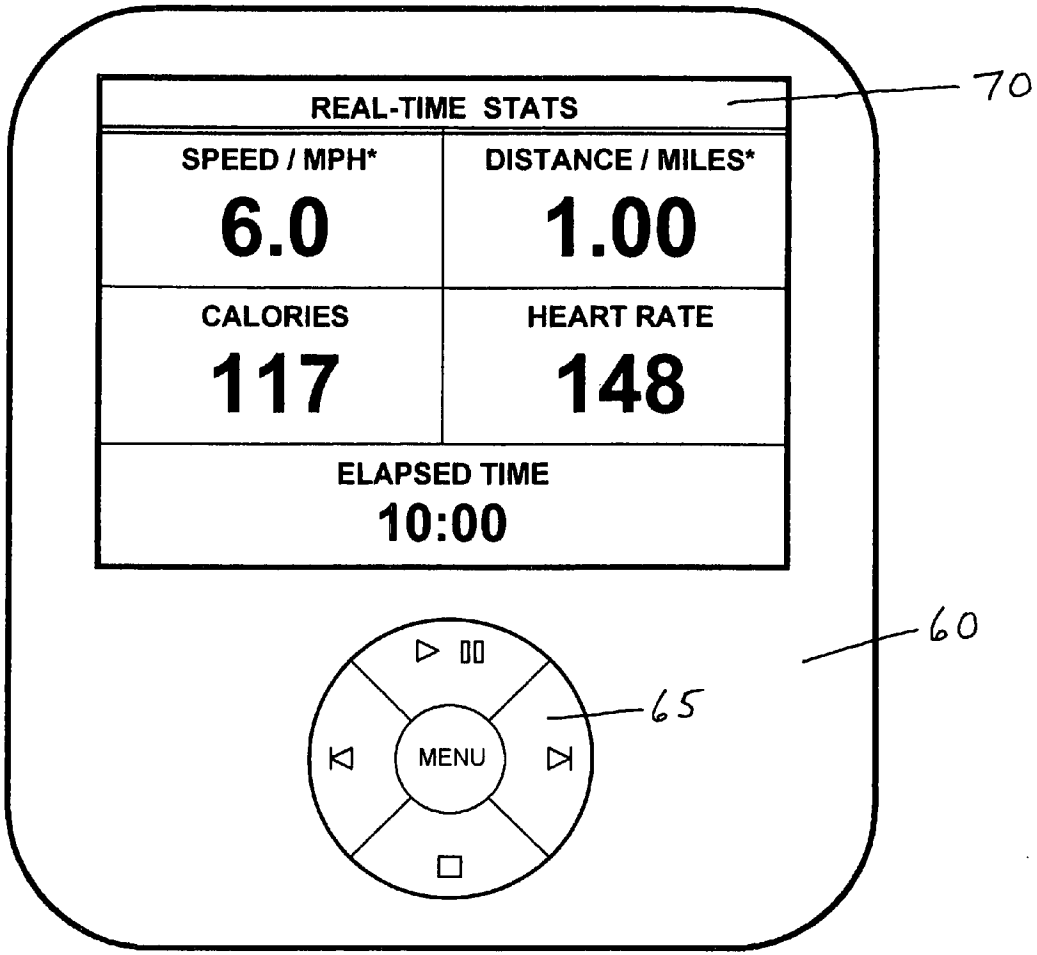
FIG. 4 shows an example of the front face of an enclosure of the preferred embodiment of this invention with a third set of displayed information.
Figure 5:
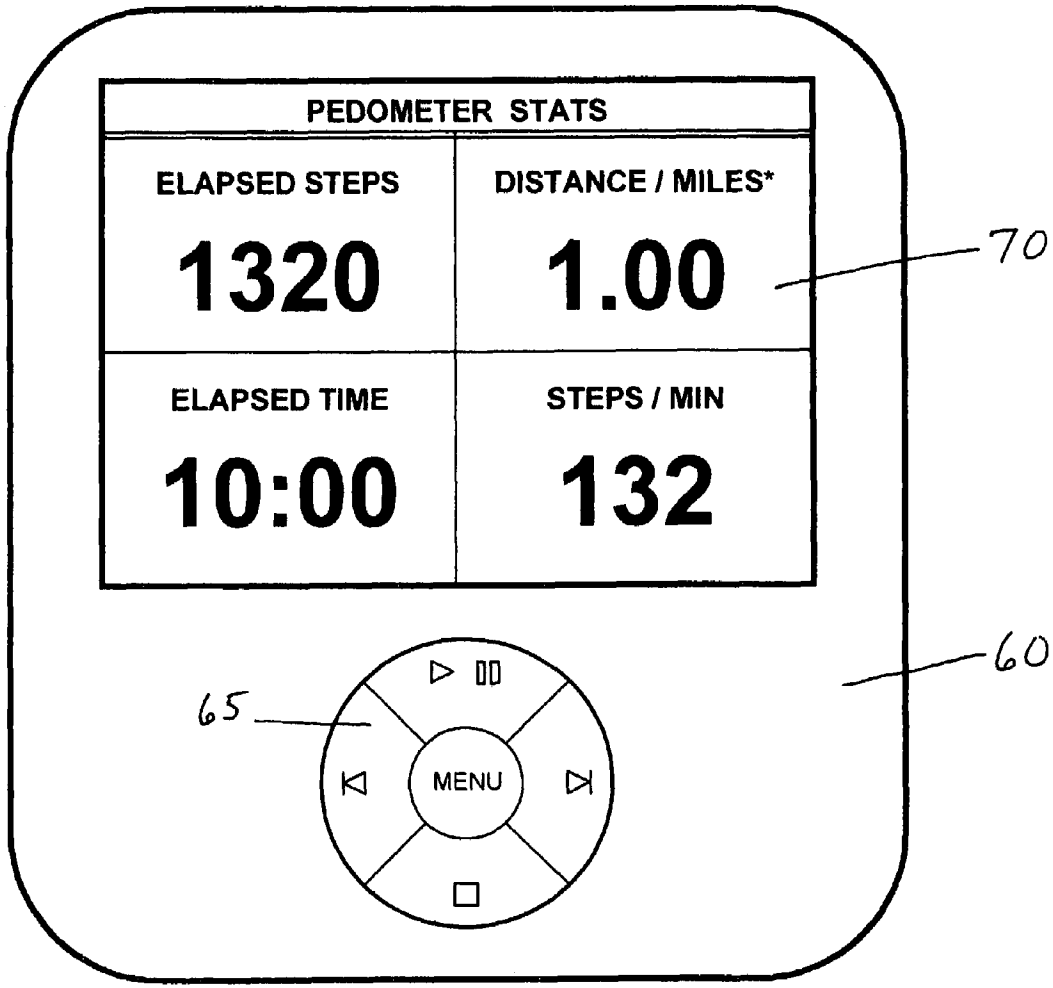
FIG. 5 shows an example of the front face of an enclosure of the preferred embodiment of this invention with a fourth set of displayed information.
Figure 6:
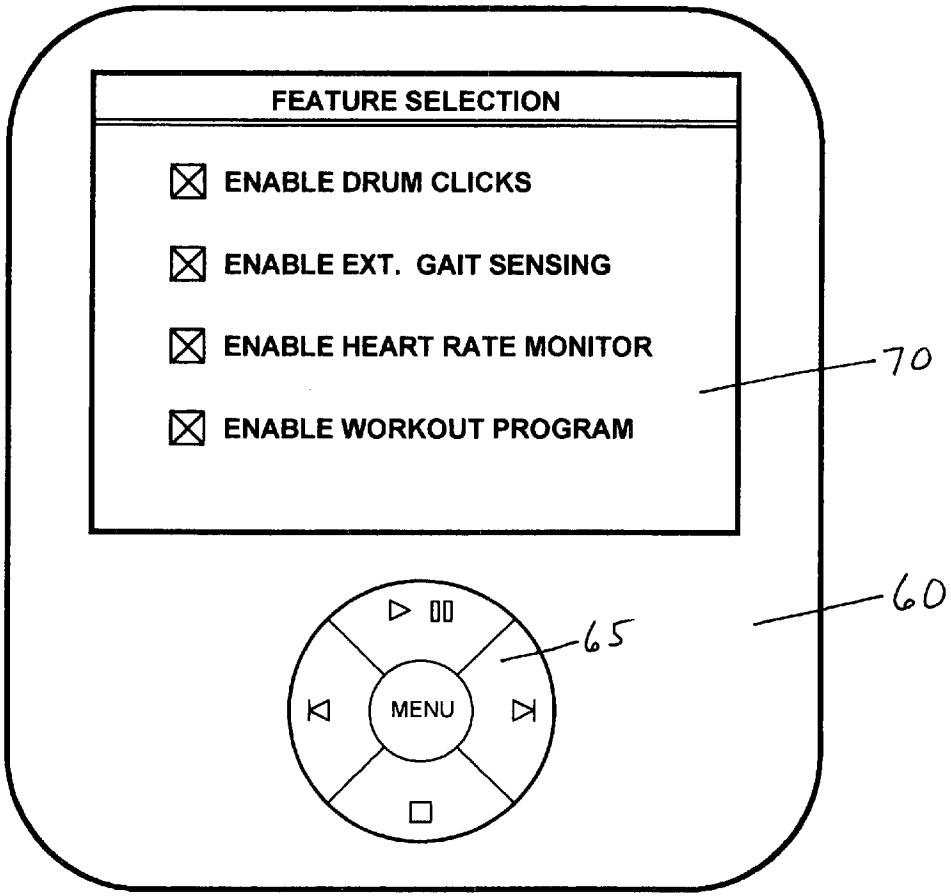
FIG. 6 shows an example of the front face of an enclosure of the preferred embodiment of this invention with a fifth set of displayed information.
Figure 7:
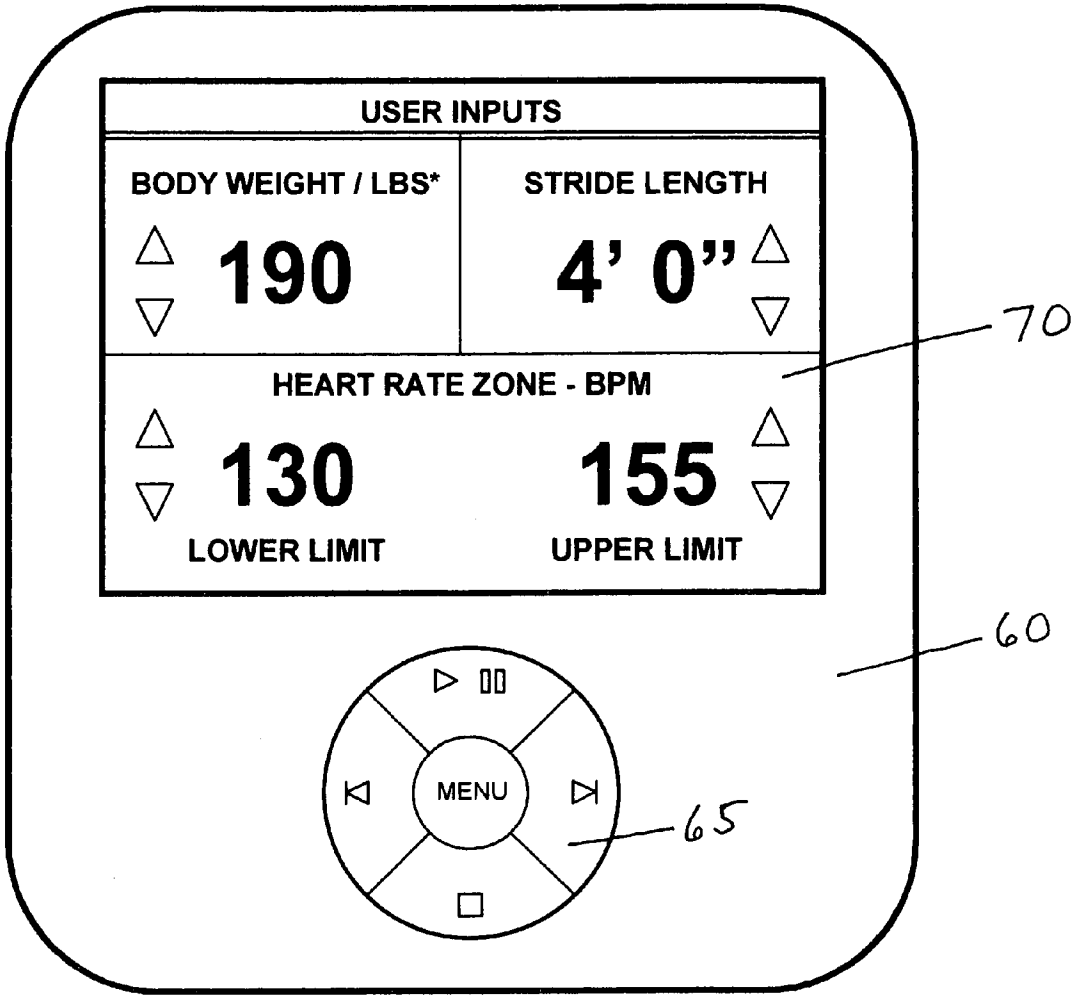
FIG. 7 shows an example of the front face of an enclosure of the preferred embodiment of this invention with a sixth set of displayed information.
Figure 8:
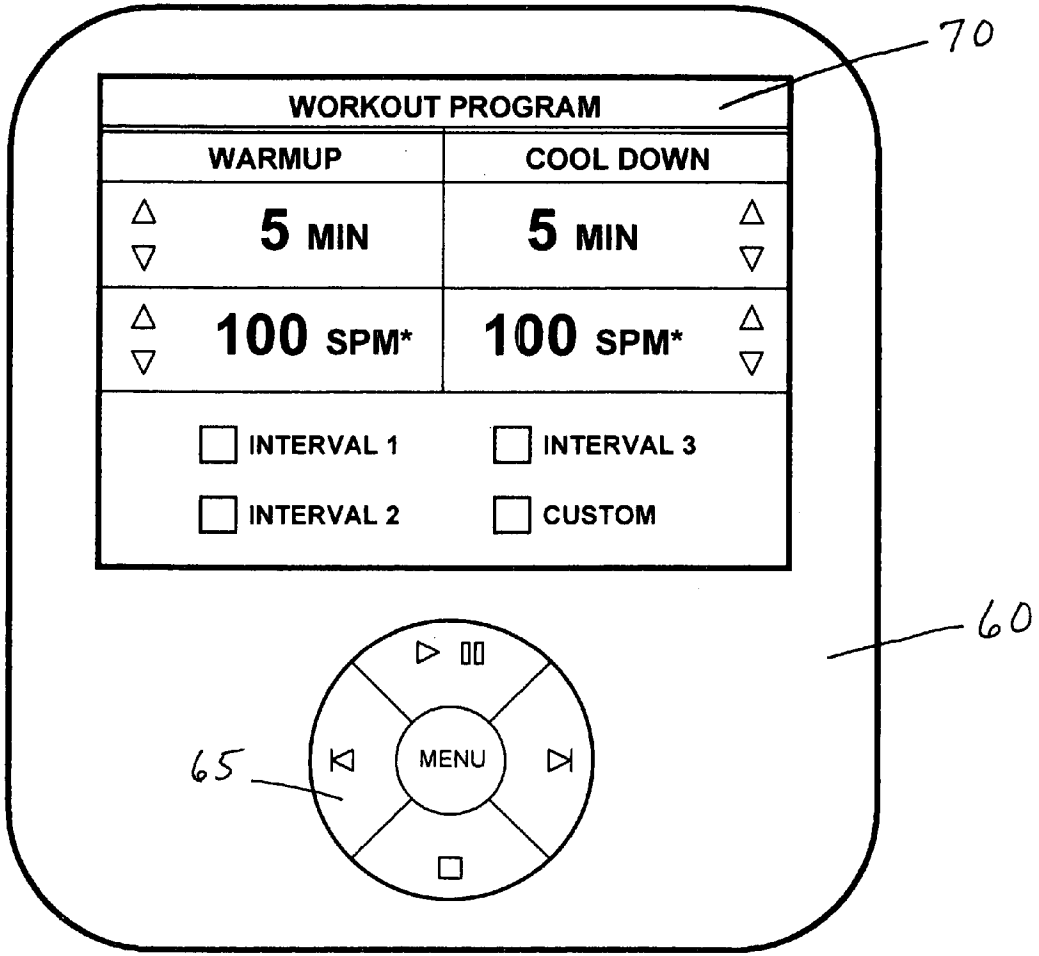
FIG. 8 shows an example of the front face of an enclosure of the preferred embodiment of this invention with a seventh set of displayed information.
Figure 9:
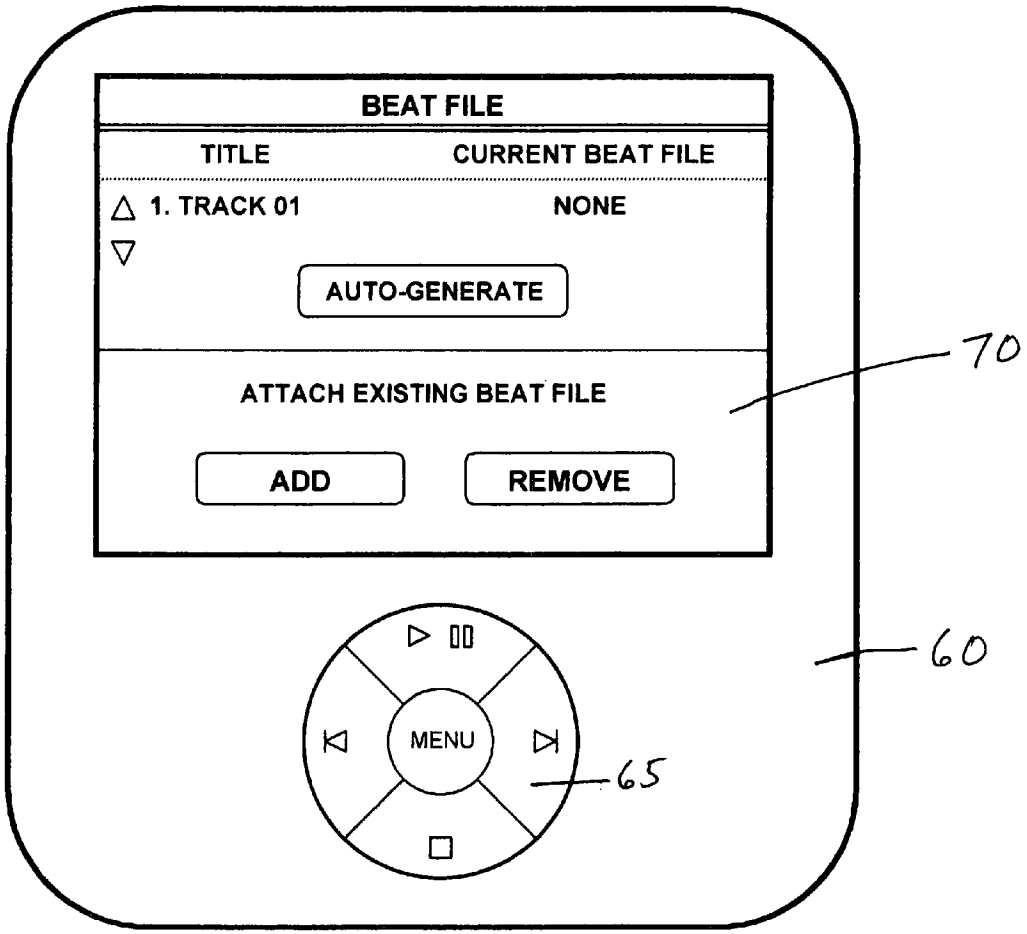
FIG. 9 shows an example of the front face of an enclosure of the preferred embodiment of this invention with an eighth set of displayed information.

FIGS. 2 through 9 illustrate, on each figure's display screen, examples of information that can be generated by the invention's microcontroller 5 and displayed to the user. FIG. 2 shows the display 70, displaying an example of the digital music computer's main menu. FIG. 3 shows the display 70 displaying an example of the play list with touch-screen user control. FIG. 4 shows the display 70 displaying an example of real-time statistics of the user's current exercise session including speed (for walking or running), distance traveled, calories expended, heart rate, and elapsed time. FIG. 5 shows the display 70 displaying an example of pedometer statistics including elapsed steps, distance traveled, elapsed time, and step rate. FIG. 6 shows the display 70 displaying an example of feature selection wherein the user can choose the operation of various features of the device. FIG. 7 shows the display 70 displaying an example of current user inputs such as the user's body weight, stride length, and desired heart rate zone. FIG. 8 shows the display 70 displaying an example of a particular work-out program selected by the user. FIG. 9 shows the display 70 displaying an example of the library of beat files contained in the device and touch-screen controls enabling the user to add new beat files and delete existing beat files.

It should be understood that the example of the musical fitness computer and the various display menus shown in FIGS. 2 to 9 are merely one possible embodiment and that nothing shown therein, or not shown, is limiting in any way. The shape, layout, orientation, components, menus, and any other feature shown in the figures could be designed or arranged in many different ways. The particular examples shown in the figures are merely illustrative and nothing about them should be considered limiting in any way.

The musical fitness computer is capable of retrieving information regarding any of the music or other audio content residing in the digital storage media, and can display a play list of music. The displayed play list may also include, for each piece of music displayed, the distance the user will or has traveled, the time that has or will elapse during exercise for that piece of music, the calories that have or will be expended, and any other quantifiable information or statistics. The display can also provide the sum totals of any displayed information. For example, if the play list lists three pieces of music, and displays the distance traveled for each piece of music, then it can sum the three distances and display the total distance to be traveled during all three pieces.

The musical fitness computer may also include a line level output for interface into external real-time recording equipment so that the user can create their own tempo mixes for use with standard playback devices.

Although this disclosure has described at least one possible embodiment of this invention, it should not be considered limiting in any way. Persons of ordinary skill in this art will be able to use the teachings of this disclosure to make different devices based on the teachings herein. The scope of this invention is meant to be limited only as set forth in the following claims.

What is claimed is:

1. A method of playing music for a human user who is engaging in a repetitive motion, comprising the steps of:

1) retrieving from a digital storage medium a digital music file,
2) creating for said digital music file a beat file,
3) overlaying said beat file on said digital music file,
4) calculating information about the music contained in the file, and
5) displaying said information.

2. The method of claim 1 wherein the repetitive motion of the human constitutes physical exercise.

3. The method of claim 1 wherein said information comprises at least one of the following:

1) beats per minute,
2) playlist,
3) current song title,
4) time elapsed,
5) gait speed,
6) stride distance,
7) heart-rate,
8) battery status,
9) speed,
10) calories burned,
11) distance traveled, and
12) at least one of steps or repetitions taken, and steps taken up to any point in a workout.

4. A method of playing music for a human user who is engaging in a repetitive motion, comprising the steps of:

1) retrieving from a digital storage medium a digital music file,
2) creating for said digital music file a beat file,
3) overlaying said beat file on said digital music file,
4) calculating or retrieving at least one statistic of the physical condition of the user, and
5) displaying said information.

5. The method of claim 4 wherein the repetitive motion of the human constitutes physical exercise.

6. The method of claim 4 wherein said information comprises at least one of the following:

1) beats per minute,
2) playlist,
3) current song title,
4) time elapsed,
5) gait speed,
6) stride distance,
7) heart-rate,
8) battery status,
9) speed,
10) calories burned,
11) distance traveled, and
12) at least one of steps or repetitions taken, and steps taken up to any point in a workout.

7. A device comprising:

1) a digital microcontroller which receives digital inputs from at least one of
   a) user controls,
   b) a pedometer, or
   c) a heart rate sensor;
2) a storage means for digitally storing at least one music file and at least one beat file, and for transmitting said at least one music file and said at least one beat file, said storage means being controlled by the microcontroller;
3) a digital signal processor, comprising a microprocessor, which receives said at least one music file and said at least one beat file from the storage means, said digital signal processor capable of overlaying a beat file onto a music file and outputting the resulting overlaid digital file, said digital signal processor being controlled by the microcontroller; and
4) an output display for receiving information from the microcontroller and displaying said information to a user.

8. The device of claim 7, wherein said information comprises at least one of the following:

1) beats per minute,
2) playlist, 3) current song title,
4) time elapsed,
5) gait speed,
6) stride distance,
7) heart-rate,
8) battery status,
9) speed,
10) calories burned,
11) distance traveled, and
12) at least one of steps or repetitions taken, and steps taken up to any point in a workout.

9. An apparatus comprising:

1) a means for a user to command a predetermined beat rate by creating a beat file;
2) a means for retrieving, from a digital storage medium, a digital music file;
3) a means for overlaying said beat file on said digital music file; and
4) a means for playing music by playing said digital music file with the overlaid beat file, whereby music plays at the beat rate commanded by the user rather than the rate at which the music was originally recorded.

10. A method of playing music for a user comprising the steps of:

1) the user commanding a predetermined beat rate by creating a beat file;
2) retrieving from a digital storage medium a digital music file;
3) overlaying said beat file on said digital music file; and
4) playing said digital music file with the overlaid beat file, whereby said music plays at the beat rate commanded by the user rather than the rate at which the music was originally recorded.

11. A device for playing music in synchrony with the repetitive motion of a human user, comprising:

1) a means of dynamically sensing the rate of voluntary repetitive motion of the user;
2) a means for storing digital music files;
3) a means for retrieving and dynamically playing at least one of said music files at a rate approximately equal to the sensed rate of repetitive motion of the user; and
4) a means for dynamically calculating and displaying at least one of information and statistics regarding at least one of the music file and the user.

* * * * *